United States Patent [19]

Fritz et al.

[11] 4,429,921

[45] Feb. 7, 1984

[54] SLIDING BEARING AND SEAL

[75] Inventors: William E. Fritz, Naperville; Thomas C. Soddy, Downers Grove, both of Ill.

[73] Assignee: The Youngstown Steel Door Company, Cleveland, Ohio

[21] Appl. No.: 342,596

[22] Filed: Jan. 25, 1982

Related U.S. Application Data

[62] Division of Ser. No. 90,301, Nov. 1, 1979, Pat. No. 4,344,365.

[51] Int. Cl.[3] ..... B61D 7/22; B61D 7/26; F16C 17/26

[52] U.S. Cl. ..... 308/3.5; 105/282 R; 277/166; 277/182

[58] Field of Search ..... 105/199 C, 282 R, 282 A; 308/3 R, 3.5, 3.6, 238, 6 R; 277/166, 182, 186

[56] References Cited

U.S. PATENT DOCUMENTS

| | | | |
|---|---|---|---|
| 2,646,333 | 7/1953 | Abrahamson et al. | 308/3.6 |
| 2,705,655 | 4/1955 | Brown et al. | 277/166 |
| 2,759,773 | 8/1956 | Wilmer et al. | 308/3.6 |
| 2,983,562 | 5/1961 | Runton et al. | 308/238 |
| 3,183,852 | 5/1965 | Fritz | 105/282 R |
| 3,509,828 | 5/1970 | Fritz | 105/282 R |
| 3,659,306 | 5/1972 | Stoltze et al. | 308/3.5 |
| 3,953,086 | 4/1976 | Chaffin | 308/3 R |
| 4,099,798 | 7/1978 | Steinmetz | 308/3.5 |
| 4,188,888 | 2/1980 | Cooper et al. | 105/199 C |
| 4,344,365 | 8/1982 | Fritz et al. | 105/282 A |

*Primary Examiner*—Randolph Reese
*Assistant Examiner*—Howard Beltran
*Attorney, Agent, or Firm*—Fay & Sharpe

[57] ABSTRACT

A sliding gate for closing the discharge opening of a hopper having inclined side walls is mounted on elongated low-friction bodies or assemblies secured between the underside of upturned inclined side margins of the gate and the top sides of inclined side walls of a discharge chute secured to the hopper and extending below the discharge opening. The elongated low-friction bodies or assemblies are mounted to create a labyrinth seal by methods which include the use of a plurality of integral stud portions extending through corresponding openings along the inclined side margins of the gate, adhesives, keyways, welding or combinations thereof. The elongated low-friction bodies or assemblies are of a polymeric material such as nylon, Teflon or a composite material like ultra-high molecular weight polyethylene impregnated with molybdenum disulfide. The polymeric low-friction material may be molded to a metal matrix which is mounted on the gate by means of welding. Tapered sealing flaps for engagement with the lower portions of the inclined side walls of the hopper may be included in the low-friction bodies or assemblies.

4 Claims, 17 Drawing Figures

SLIDING BEARING AND SEAL

This application is a division, of application Ser. No. 90,301, filed Nov. 1, 1979, now U.S. Pat. No. 4,344,365, issued Aug. 17, 1982.

BACKGROUND OF THE INVENTION

This invention is an improvement over the hopper car gate apparatus and method of construction disclosed in Fritz U.S. Pat. No. 3,183,852 issued May 18, 1965 and U.S. Pat. No. 3,509,828 issued May 5, 1970.

The invention relates to railway hopper car gate outlets. More particularly, the invention provides an anti-friction support for a hopper gate during translatory movement between open and closed positions and is characterized by a simple apparatus which is self-cleaning, resists cocking and binding, is easy to repair and to maintain and which provides a labyrinth seal to minimize or eliminate loss of lading.

The prior construction of sliding gates for closing the discharge opening of a hopper, as illustrated by Fritz U.S. Pat. No. 3,183,852, for example, provided improved sealing over previous sliding gates but was not self-cleaning and often was subject to cocking and binding. The Fritz U.S. Pat. No. 3,509,828 taught the use of inclined self-cleaning surfaces and spacing of the gate from the discharge chute to reduce to a minimum the likelihood of binding therebetween during movement of the gate due to large granules of lading. This latter Fritz patent, however, required an elaborate fabricated roller apparatus and assembly method which created sealing problems, particularly when the rollers began to wear during use. The apparatus and method of construction of the instant invention combines the best advantages of these prior patents in a novel manner which eliminates or minimizes their inherent problems.

SUMMARY OF THE INVENTION

The discharge outlet assembly of the invention is for use with, and includes, a hopper having downwardly inclined side and end walls defining a discharge opening. Extending below the discharge opening and secured to the hopper is a discharge chute having inclined side walls. The sliding gate for closing the discharge opening has upturned inclined side margins underlying the lower portions of the side walls of the hopper. Elongated low-friction bodies or assemblies are secured parallel to the direction of travel of the gate between the underside of the upturned inclined side margins of the gate and the top sides of the inclined side walls of the discharge chute to provide a labyrinth seal.

The elongated low-friction bodies or assemblies may be of a polymeric material such as nylon, Teflon or of a composite low-friction material like ultra-high molecular weight polyethylene impregnated with an anti-friction material such as molybdenum disulfide. The bodies or assemblies may be secured by various means including, but not limited to, integral stud portions which extend through spaced openings along the side margins of the gate. The stud portions can have flanged heads which are force fit through the openings or which are formed by peening or melting after assembly. If desired, integral flanges may be provided on the bodies to overlie the openings and integral stud portions. Alternatively, the bodies or assemblies maay be held adhesively in position by adhesives.

In the case of a composite low-friction material, the bodies or assemblies may be secured by various means including, but not limited to, adhesives, keyways, or welding. In the latter case, before welding the anti-friction assemblies to the side margins of the gate, they are fabricated, for example, by providing an expanded steel mesh with a steel backing strip welded to it and the composite low-friction material molded to it. Integral tapered projecting flaps for sealing and sliding engagement with the lower portions of the inclined side walls of the hopper may also be provided on the bodies or assemblies, both of which may also have surfaces which guide the gates in a straight path during the opening and closing operations.

DESCRIPTION OF THE PREFERRED EMBODIMENTS

Figure 1:
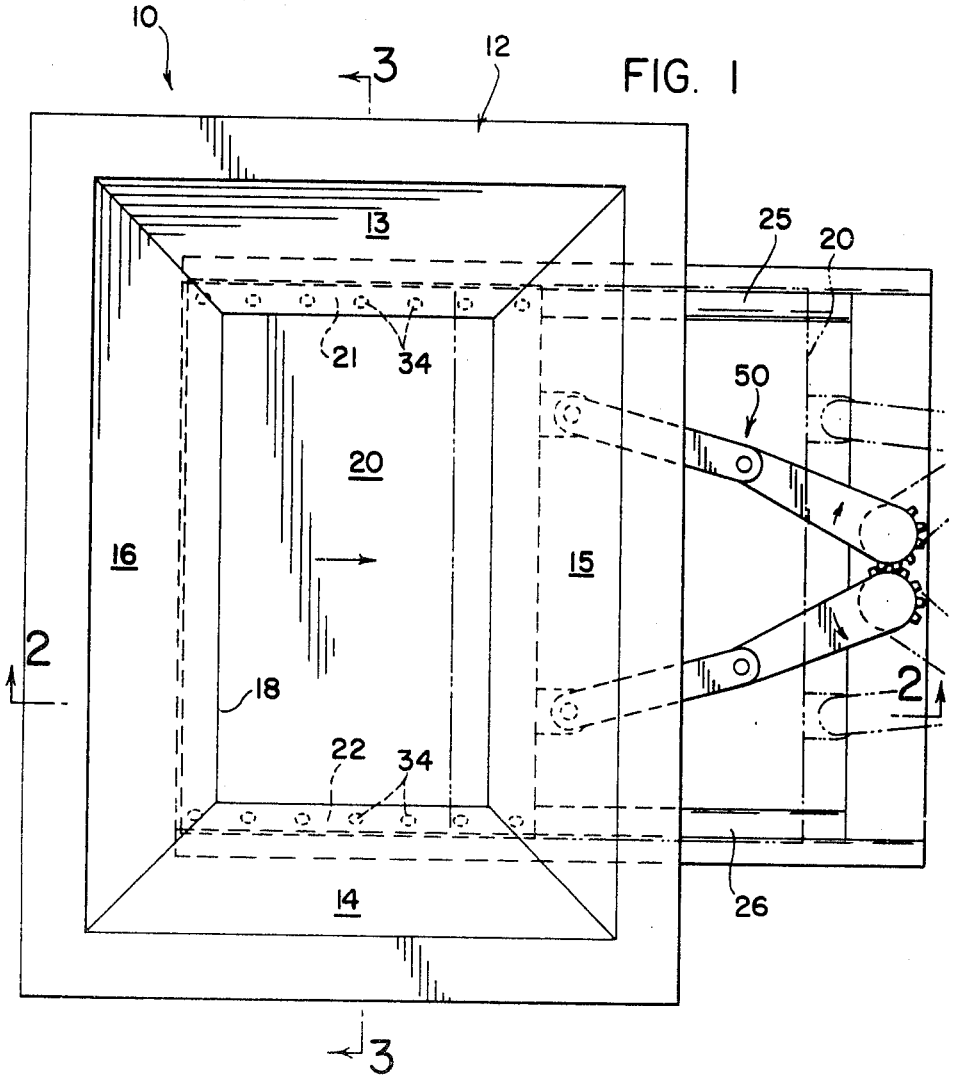
FIG. 1 is a plan view of a discharge outlet assembly constructed in accordance with the principles of this invention with the gate in closed position.

The numeral 10 generally designates a discharge outlet assembly. The assembly 10 includes a hopper 12 having inclined side walls 13 and 14 and inclined end walls 15 and 16 respectively. The inclined side walls 13 and 14 and end walls 15 and 16 define a discharge opening 18 which is closed by sliding gate 20 as shown, for example in FIG. 1, in full in the closed position and in phantom in the opened position.

The sliding gate 20 has upturned inclined side margins 21 and 22 which are below the lower portion of the side walls 13 and 14 of the hopper 12 and substantially parallel thereto and spaced therefrom. Attached to the hopper 12, as by means of welding, is a discharge chute 24. The discharge chute 24 includes inclined side walls 25 and 26 which, with the lower portions of the side walls 13 and 14 of the hopper 12, define a slot into which the upturned margins 21 and 22 of gate 20 are received.

Between the underside of the upturned inclined side margins 21 and 22 of the gate 20 and the inclined side walls 25 and 26 of the discharge chute 24 are located elongated low-friction bodies 30. The low-friction bodies 30 are secured to the upturned margins 21 and 22 by means of integral stud portions 32. On the ends of integral stud portions 32 opposite the elongated body portion of the low-friction bodies are integral flanged portions 34. The integral stud portions 32 extend through spaced openings 36 in the upturned side margins 21 and 22 with the flanged portions 34 on the sides of these margins opposite the elongated body portions 30' of the low-friction bodies 30.

Figure 4:
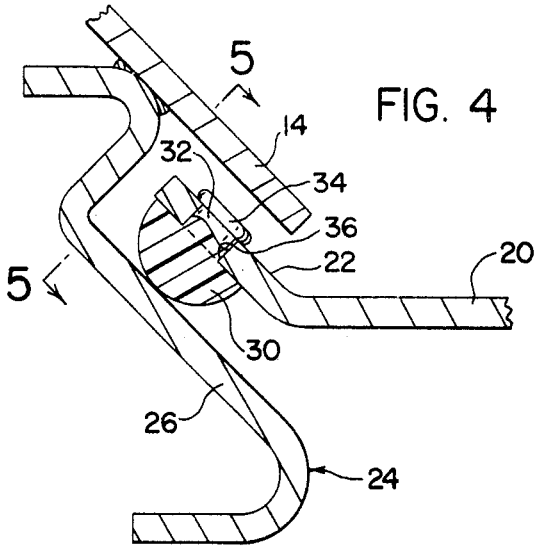
FIG. 4 is a fragmentary cross-sectional view of the inclined sidewall 26 area of FIG. 3.
Figure 5:
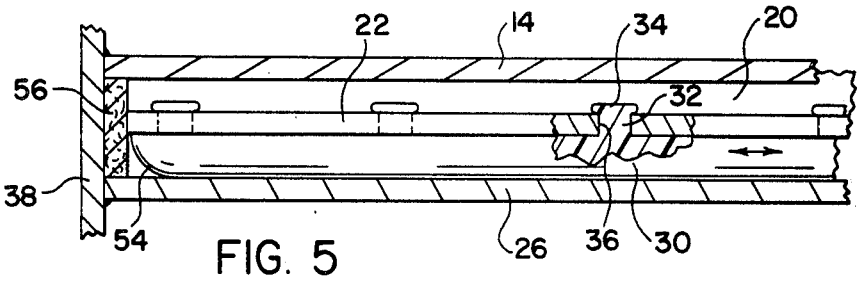
FIG. 5 is a cross-sectional view taken along the line 5—5 of FIG. 4.
Figure 6:
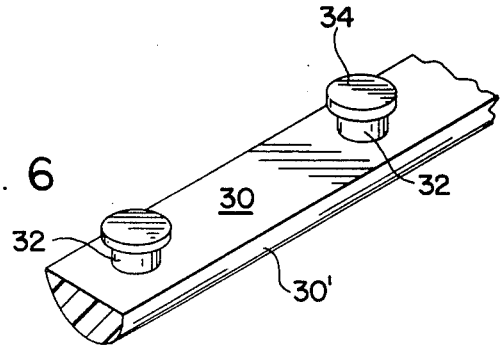
FIG. 6 is a perspective view of a portion of one of the elongated low-friction bodies utilized in the embodiment of FIGS. 2 through 5.

The elongated low-friction bodies 30 and their integral stud portions and flange portions 32 and 34 may be made of polymeric materials such as the nylon and Teflon materials of the DuPont Co. or the Nylatron material produced by Polymer Division of ACF Industries, Inc. The stud portions 32 and flanged portions 34 of the elongated low-friction bodies 30 made from these elastomeric anti-friction materials can be force fit through the openings 36 in the side margins 21 and 22 into the assembled positions shown, for example, in FIG. 4. The flanged portions 34, accordingly, will hold the elongated low-friction bodies 30 in place, parallel to the direction of travel of gate 20, between the inclined margins 21 and 22 and the inclined side walls 25 and 26 of the discharge chute 24. The elongated low-friction bodies 30 may also be constructed of a composite low-friction metallic material such as ultra-high molecular weight polyethylene impregnated with molybdenum disulfide and sold under the trademark Duraguard.

Figure 2:
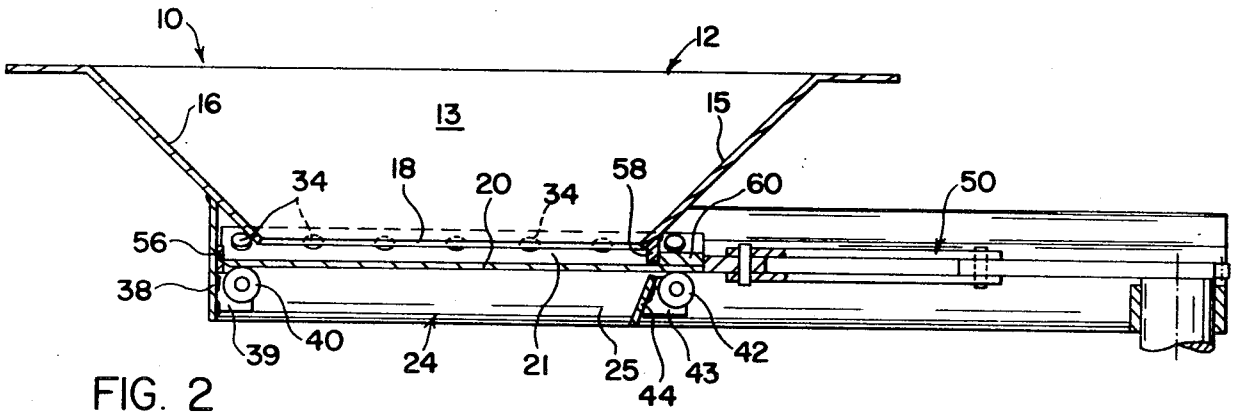
FIG. 2 is a cross-sectional elevational view taken along the line 2—2 of FIG. 1.
Figure 3:
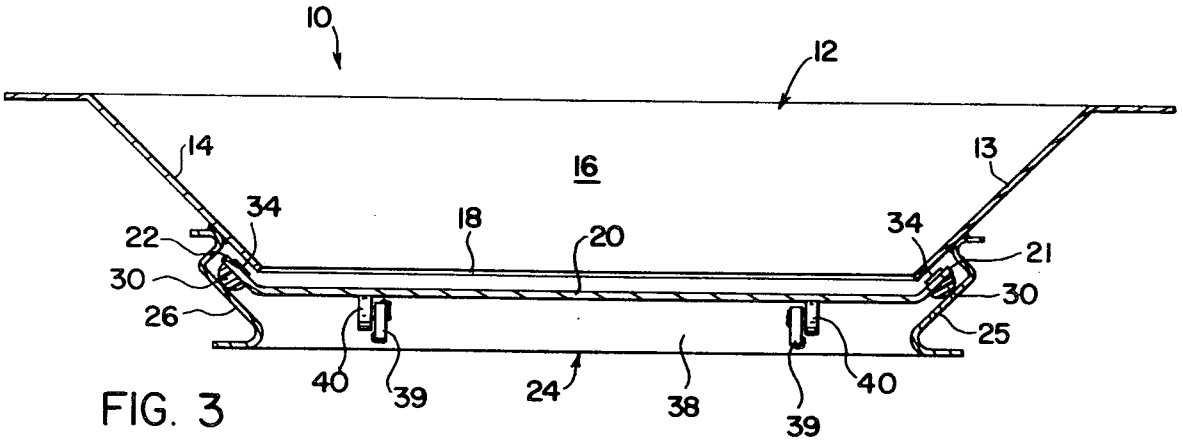
FIG. 3 is a cross-sectional elevational view taken along the line 3—3 of FIG. 1.

As seen, for example in FIG. 2, the discharge chute 24, in addition to its inclined side walls 25 and 26, includes an end wall 38. The end wall 38 is secured, as by means of welding, to the end wall 16 of the hopper 12 and is oriented in a generally vertical direction to close off the end of the slots formed between the lower portions of the hopper's inclined side walls 13 and 14 and the discharge chute 24's inclined side walls 25 and 26. The end wall 38 has a pair of inwardly projecting brackets or support plates 39 welded thereto by means of which end rollers 40 may be mounted on horizontal axes. The end support rollers 40 work in association with a pair of rollers 42 to give intermediate anti-friction support at the ends, midway of the width, of the gate 20. Rollers 42 are mounted by means of brackets 43 on a front plate 44 of discharge chute 24. The rollers 40 and 42 cooperate with a suitable operating mechanism, generally designated by the numeral 50, for moving the gate 20 between the closed and opened positions.

The illustrated mechanism of FIGS. 1 and 2 includes operating linkages of the type illustrated in Fritz U.S. Pat. No. 3,509,828. This particular operating mechanism is shown by way of example only and any of the prior art mechanisms for producing translatory motion of the gate 20 is contemplated to be utilized in connection with the instant invention.

The manner in which the low-friction bodies 30 guide the gate 20 in its translatory movement between the opened and closed positions is an important aspect of the invention. The low-friction bodies 30 are provided with a leading rounded surface 54 which, because of its shape, is self-cleaning of any lading which may adhere or come to rest upon the inclined surface 26 of the discharge chute 24 as the gate 20 moves toward the closed position. The rounded leading edge 54 comes in contact in the closed position of the gate 20 with a resilient gasket 56. The resilient gasket 56 is secured, as by means of adhesive, to the vertical front end wall 38 of discharge chute 24. The rear seal of the gate is accomplished by means of an extension 58 on the inclined end wall 15 of the hopper 12 against which a transverse gasket or bar 60 mounted on and traveling with the gate 20 comes in contact.

A labyrinth seal along the sides of gate 20 is created by means of the low-friction bodies 30. The inclined margins 21 and 22 of the gate 20 slide on the bodies 30 and the inclined side walls 25 and 26 of the discharge chute 24. As will be seen, any lading weight on the gate 20 will tend to increase the seal made between the low-friction elongated bodies 30 and the inclined surfaces 25 and 26. In addition, because of the inclines of the side walls 13 and 14 and the gate side margins 21 and 22, for any significant lading to escape, it would first have to travel upward and around margins 21 and 22 and then downward through the seal made between low-friction bodies 30 and inclined surfaces 25 and 26.

Figure 7:
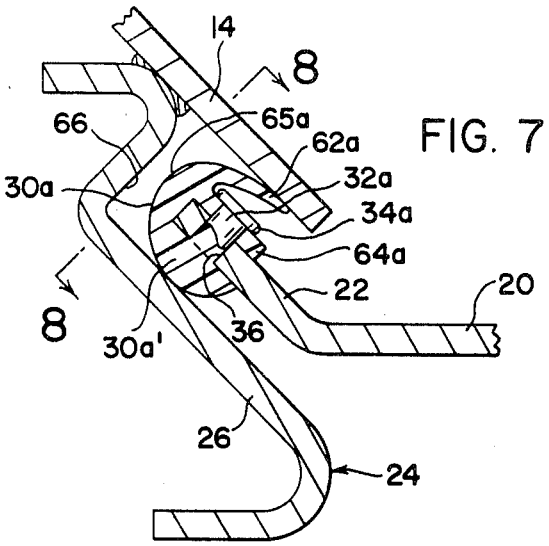
FIG. 7 is a fragmentary cross-sectional view similar to FIG. 4 showing an alternative embodiment.
Figure 8:
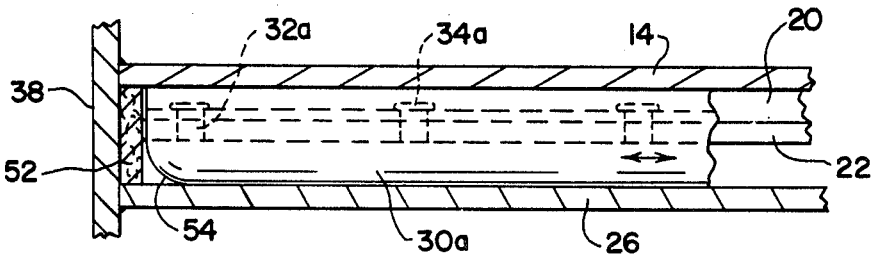
FIG. 8 is a cross-sectional view taken along the line 8—8 of FIG. 7.
Figure 9:
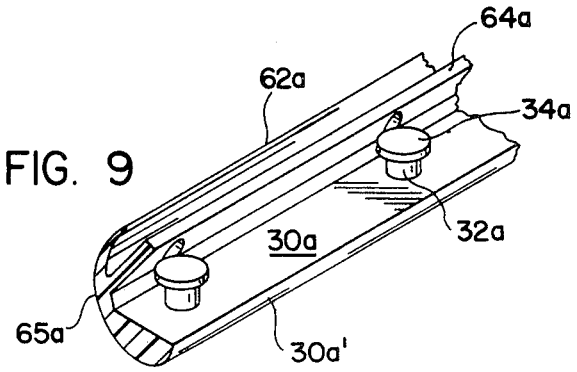
FIG. 9 is a perspective view of a portion of one of the elongated low-friction bodies utilized in the embodiment of FIGS. 7 and 8.

For improved straight line guidance and sealing of gate 20, the embodiment of FIGS. 7 through 9 can be employed in which the low-friction bodies **30*a* include an integral projecting tapered flap portion 62*a* for sliding and sealing engagement with the lower surface of the inclined side walls 13 and 14 of the hopper 12. These sealing flaps provide a sliding seal engagement which increases the labyrinth sealing action to insure a minimum leakage of lading, if any. In this regard it should be noted that the projecting integral flap seal 62*a* is of such length that even if lading should move the gate 20 downwardly toward the inclined surface 26 in a manner deforming the gate 20 and elongated body portions 30*a*', the flap seal 62*a* may still be in sealing engagement with the underside of the inclined walls 13 and 14 of hopper 12**.

Low-friction bodies **30*a* also may be provided with an integral flange portion 64*a* for cooperation with integral stud portions 32*a* and flanged ends 34*a*. The integral flange portion 64*a* overlies the uppermost surface of the side margins 21 and 22 of the gate 20 and their integral flanges 34*a* may be secured on the side of the integral flange 64*a* opposite the side margins 21 and 22 to secure the elongated low-friction bodies 30*a*** to the side margins for travel therewith.

The body **30*a* includes a surface 65*a* which is the outer surface of the material which connects the projecting tapered flap portion 62*a* and the integral flange portion 64*a* with the main portion 30*a*' of the body 30*a*. This surface 65*a*, in the event there is any tendency for the gate 20 to cock during its translatory motion, will slidingly engage the inner surface 66 of the discharge chute 24 and be guided in a substantially straight tracking direction thereby preventing undesirable cocking and binding during the opening and closing operations of gate 20**.

Figure 10:
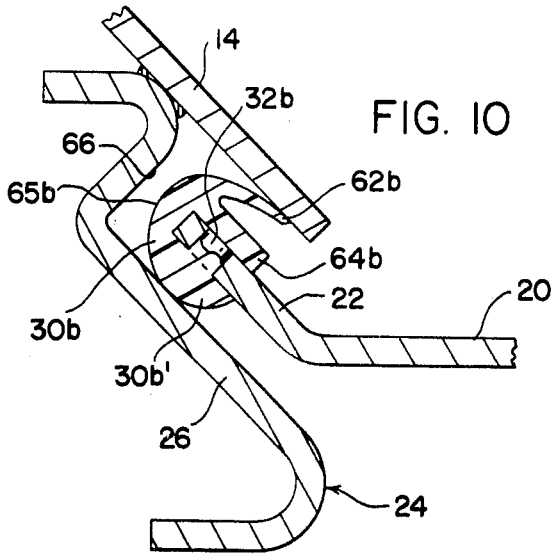
FIG. 10 is a fragmentary cross-sectional view similar to FIGS. 4 and 7 showing another alternative embodiment.
Figure 11:
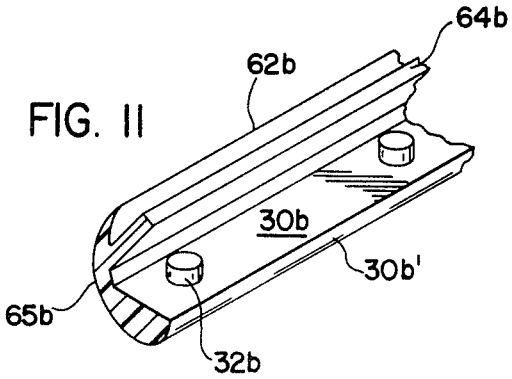
FIG. 11 is a perspective view of a portion of one of the elongated low-friction bodies utilized in the embodiment of FIG. 10.

In FIGS. 10 and 11, an alternative elongated low-friction body embodiment 30*b* is seen which may be identical to the embodiment of the bodies 30 and 30*a* except that instead of utilizing integral flanged portions 34*a* the integral studs 32*b* are of such length that they come into direct engagement with an integral flange 64*b*. The integral flange 64*b* of this embodiment has no openings in it for passage of the integral stud portions 32*b*. Accordingly, the securing of elongated low-friction bodies 30*b* is accomplished by means of an epoxy or other suitable adhesive material. It will be obvious that the embodiment of FIGS. 1 through 6 could be mounted by means of an adhesive material without the use of integral flanged portions 34 in like manner. The body 30*b* includes a main body portion 30*b'*, a sealing flap portion 62*b* and a guide surface 65*b* whose functions are described with respect to the embodiment of FIGS. 7–9.

Figure 12:
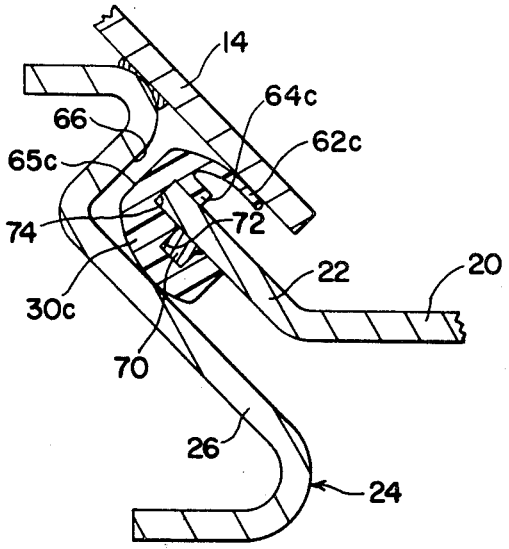
FIG. 12 is a fragmentary cross-sectional view, similar to FIGS. 4, 7 and 10, showing another alternative embodiment.
Figure 13:
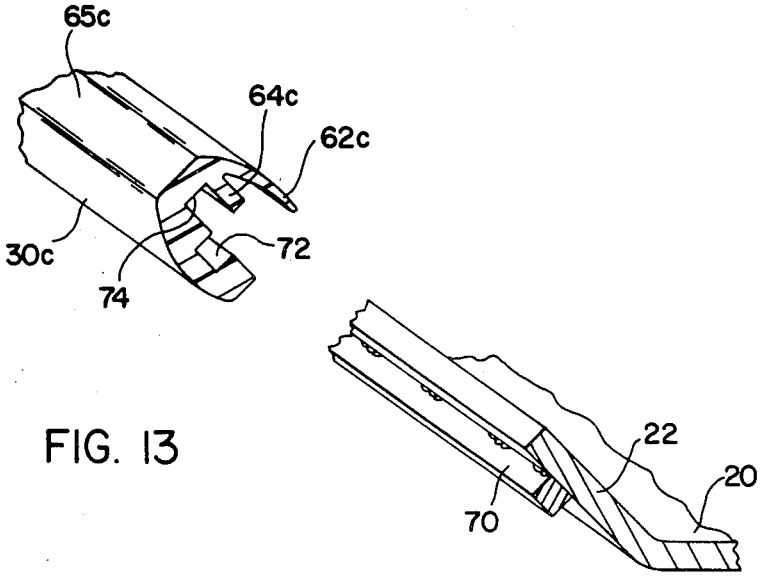
FIG. 13 is a perspective view of a portion of the gate 20 and of one of the elongated low-friction bodies within the enclosing bracket utilized in the embodiment of FIG. 12.

In FIGS. 12 and 13, an alternative elongated low-friction body embodiment 30*c* is seen which may be identical to the embodiment of the bodies 30, 30*a* and 30*b* except that an elongated key 70 is welded to the underside of side margin 22 of the gate 20 such that a keyway or groove 72 can receive the key 70 therein along the longitude of member 30*c*. A guide surface portion 65*c* can engage inner surface 66 of discharge chute 24 and a sealing flap 62*c* engages the lower portion of the inclined side wall 14 of hopper 12. Groove 74 is formed in the body 30*c* between the sealing flap 62*c* and the keyway 72 and has for its upper defining portion an integral stub flange 64*c*. The body 30*c* can be adhesively secured in position, in addition to the mechanical mounting which the key 70 and keyway 72 and edge of margin 22 and groove 74 provide.

Figure 14:
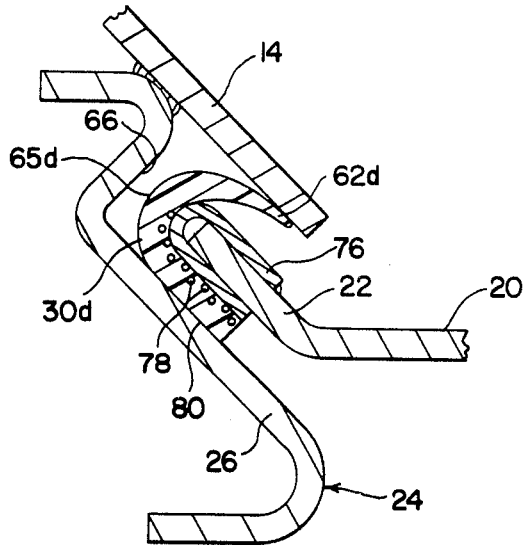
FIG. 14 is a fragmentary cross-sectional view, similar to FIGS. 4, 7, 10 and 12, showing another alternative embodiment.
Figure 15:
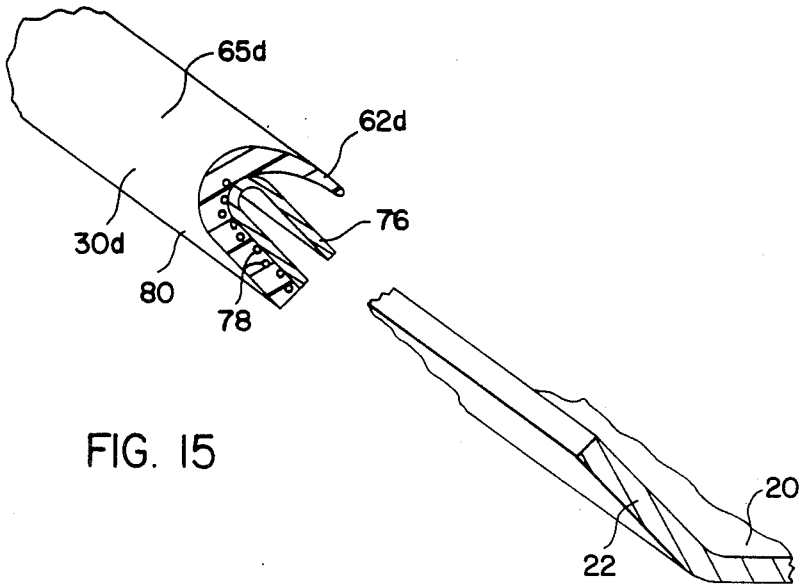
FIG. 15 is a perspective view of a portion of the gate 20 and of one of the elongated low-friction bodies within the enclosing bracket utilized in the embodiment of FIG. 14.

In FIGS. 14 and 15, a low-friction assembly 30*d* is shown with a channel defining steel strip 76 and an expanded metal matrix 78 welded thereto. The matrix 78 has one of the polymeric low-friction materials molded thereto. The channel defining steel strip 76 fits over the side margin 22 of gate 20 and is secured thereto as by welding. The low-friction material can be molded to define an elongated sealing flap 62*d* for engagement with the underside of the inclined side wall 14 of the hopper 12. The outer surface of the body 30*d* defines an elongated guide surface 65*d* for engagement with the inner surface 66 of the discharge chute 24. A lower load bearing surface 80 supports the body 30*d* in sliding engagement with the inclined side wall 26 of the discharge chute 24.

Figure 16:
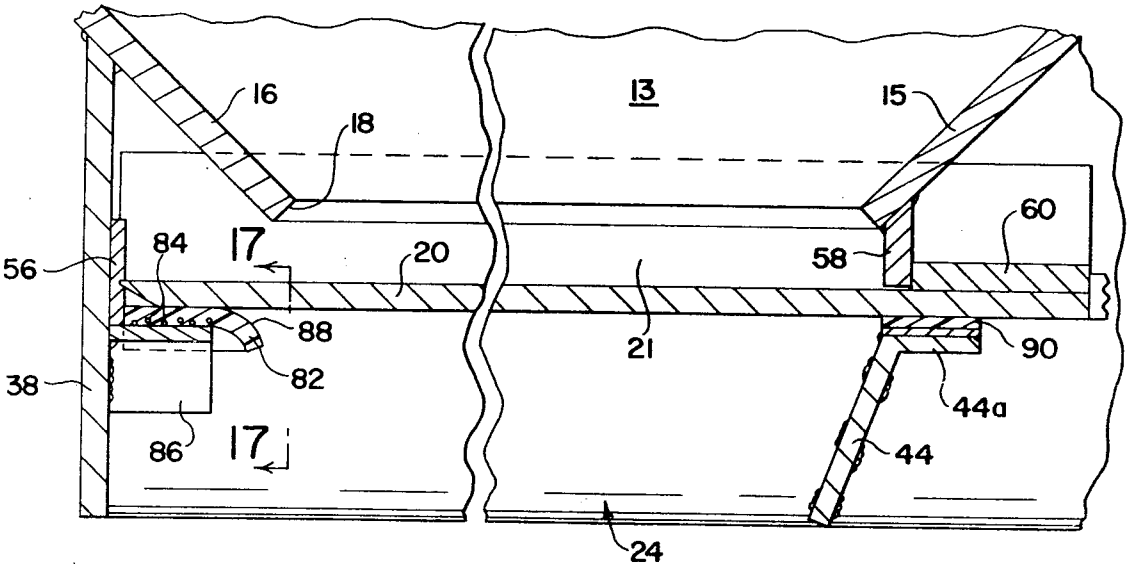
FIG. 16 is a fragmentary cross-sectional elevational view showing an alternative to the gate end and anti-friction support means embodiment illustrated in FIGS. 2 and 3.
Figure 17:
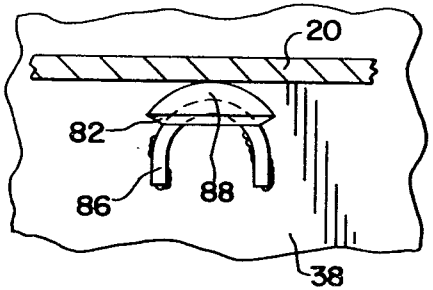
FIG. 17 is a fragmentary cross-sectional elevational view taken along the line 17—17 of FIG. 16.

In FIGS. 16 and 17 an alternative to the use of end support rollers 40 and 42 for the gate 20 is illustrated. As will be seen, a polymeric low-friction material 82 molded to a metal matrix 84 forms an assembly which is welded to inwardly projecting brackets or support plates 86. It will be seen that the molded material 82 has a gently curving portion 88 for camming engagement by the leading edge of the gate 20. This structure replaces the inwardly projecting brackets or support plates 39 welded to end wall 38 and the rollers 40 mounted thereon. At the other end of the structure, in place of rollers 42 and brackets 43, on front plate 44 of discharge chute 24 polymeric low-friction seal 90 is provided. The seal 90 is mounted on a flanged portion 44*a* at the top of the front plate 44 and provides a tightly fitting sliding seal for the gate 20 in a manner which eliminates the necessity of rollers 42 and brackets 43.

Thus, applicant has provided an anti-friction support and guide for a hopper gate during translatory movement between open and closed positions which is characterized by a simple apparatus which is self-cleaning, resists cocking and binding, is easy to repair and maintain and which provides a labyrinth seal to minimize or eliminate the loss of lading.

We claim:

1. An elongated low-friction body comprising an elongated channel defining steel strip having a metal matrix welded thereto, said matrix including a polymeric low-friction material molded thereto defining an elongated guide surface opposite said channel and an elongated load bearing surface between said channel and said guide surface, one side of said channel being defined by a flange extending along the length of said body with said molded polymeric material further defining an elongate integral tapered projecting sealing flap extending at least partly over said flange in outwardly-spaced relationship thereto along the length of said body.

2. An elongated body of low-friction polymeric material, a substantially flat surface extending along the length of said body, a flange extending along the length of said body in spaced-apart relationship to said flat surface to define a mounting channel therebetween, a plurality of studs extending outwardly from said flat surface toward said flange and being spaced-apart from one another along the length of said body, and means for attaching said studs to said flange.

3. The body of claim 2 including a flexible sealing flap extending along the length of said body in outwardly spaced at least partly overlying relationship to said flange.

4. The body of claim 3 wherein said sealing flap is curved outwardly transversely of said body and tapers to a reduced thickness toward the free end thereof.

* * * * *